US006784387B2

(12) United States Patent
Takano

(10) Patent No.: US 6,784,387 B2
(45) Date of Patent: Aug. 31, 2004

(54) INTERLOCK DEVICE

(75) Inventor: Takahiro Takano, Yamanashi (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/141,964

(22) Filed: May 10, 2002

(65) Prior Publication Data

US 2002/0170808 A1 Nov. 21, 2002

(30) Foreign Application Priority Data

May 16, 2001 (JP) ..... 2001-147046

(51) Int. Cl.[7] ..... H01H 3/16
(52) U.S. Cl. ..... 200/61.69; 200/50.1; 200/61.81
(58) Field of Search ..... 200/50.1, 61.69, 200/61.7, 61.81, 61.8

(56) References Cited

U.S. PATENT DOCUMENTS 2,408,213 A * 9/1946 Huber ..... 200/1.69
2,455,780 A * 12/1948 Kohout ..... 200/81.81
3,428,768 A * 2/1969 Kauffman ..... 200/61.69

* cited by examiner

*Primary Examiner*—Renee Luebke
(74) *Attorney, Agent, or Firm*—McGinn & Gibb, PLLC

(57) ABSTRACT

An interlock device for a switch housed within a casing of a double door structure includes a lever, pivotably supported at an intermediate portion, that pivots a first end portion of said lever downward, when the first door closes a portion of said opening, a link member with a stud, the stud moving the link member upward from a first position to a second position, when the first door is closed, a pushing member mounted on a guide plate of the link member, the pushing member being pushed inward, when the link member is located at the second position, and a switch that turns ON a power supply, when the pushing member contacts the switch in the third position.

18 Claims, 3 Drawing Sheets

INTERLOCK DEVICE

BACKGROUND OF THE INVENTION

1. Field of the Invention

The present invention relates to an interlock device for turning ON a power source of a device housed within a casing when both of hinged double doors are closed.

2. Description of the Related Art

Many apparatuses, such as control panels and so on, are housed within a housing with a door. When the apparatus is in operation, the door of the casing is held closed. Upon maintenance and inspection of the apparatus and replacement of consumable articles and so forth, the power supply is turned OFF and the door is opened to perform necessary operation. In such apparatus, in order to avoid the occurrence of a misstep of turning ON the power supply while the door is held open or the misstep of opening the door while the apparatus is in operation, an interlock device for enabling power supply to the apparatus only when the door is closed, is provided. The interlock device is provided with an interlock switch (hereinafter simply referred to as switch). The switch is held ON while the door is held closed, for enabling power supply to the apparatus.

On the other hand, among various casings, there are some casings of the type having two doors for one opening, such as a hinged double door, for example. The casing of this type is advantageous due to the motion area of the door in comparison with the size of the opening portion.

However, such prior art encounters the following problems. In the case of the method providing the switch per the door, the number of switches is increased to make a cost of the interlock device higher. As a result, the cost of the overall apparatus, such as a control panel or so forth, is significantly influenced.

On the other hand, in the case of the method providing only one switch for one of the doors, the power may be supplied while the door provided with the switch is closed, irrespective of the position of other doors. Thus, such an approach encounters a problem from the viewpoint of security.

The present invention has been worked out in view of the drawbacks set forth above. It is an object of the present invention to provide an interlock device for a casing of double door structure, which can enable a power supply with one switch only when both doors are closed.

According to one aspect of the present invention, an interlock device applicable for a casing having an opening opened and closed by a first door and a second door in hinged double door construction for supplying power to an apparatus housed within the casing when both of the first door and the second door are closed, comprises:

- a lever pivotably supported at an intermediate portion and being pivoted in a predetermined direction as pushed one end portion by the first door when the first door is closed;
- a link member responsive to pivot motion of the lever to the predetermined position and driven by the other end of the lever to be moved from a first position on the side of the first door to a second position on the side of the second door;
- a pushing member mounted on the link member and responsive to closure of the second door while the link member is placed at the second position, to be pushed into a third position; and

- a switch responsive to the pushing member placed at the third position to turn ON power supply for the apparatus.

As set forth above, in the present invention, the link member is moved from the first position to the second position by closing the first door. Then, by closing the second door, the pushing member is pushed into the third position to turn the switch ON by the pushing member. Thus, with one switch, the power is supplied to the apparatus only when both of the first and second doors are closed.

In the preferred construction, the pushing member may be mounted on the link member in such a manner that a direction of movement (e.g., pushing) intersects with moving direction of the link member.

On the other hand, the pushing member may be constantly placed at a fourth position and may be pushed to move when the second door is closed, and a first resilient member biasing the pushing member toward the fourth position may be provided between the link member and the pushing member.

Also, the first and second doors may be pivoted about horizontal shafts, the opening portion may be arranged at the front side of the casing, and the lever may be pivotable about a horizontal shaft, the first position may be arranged lower than the second position, and the link member may be constantly biased toward the first position by gravity.

The interlock device may further comprise a second resilient member provided between the casing and the link member and constantly biasing the link member toward the first position.

Preferably, the lever may be bent at a pivot portion pivotably supported on the horizontal shaft so that one portion and the other portion extend in mutually different directions, and side edges of the one portion and the other portion to be pushed by the first door intersect at an angle greater than 180°.

BRIEF DESCRIPTION OF THE DRAWINGS

The present invention will be understood more fully from the detailed description given hereinafter and from the accompanying drawings of the preferred embodiment of the present invention, which, however, should not be taken to be limiting to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscurity of the present invention.

Figure 1:
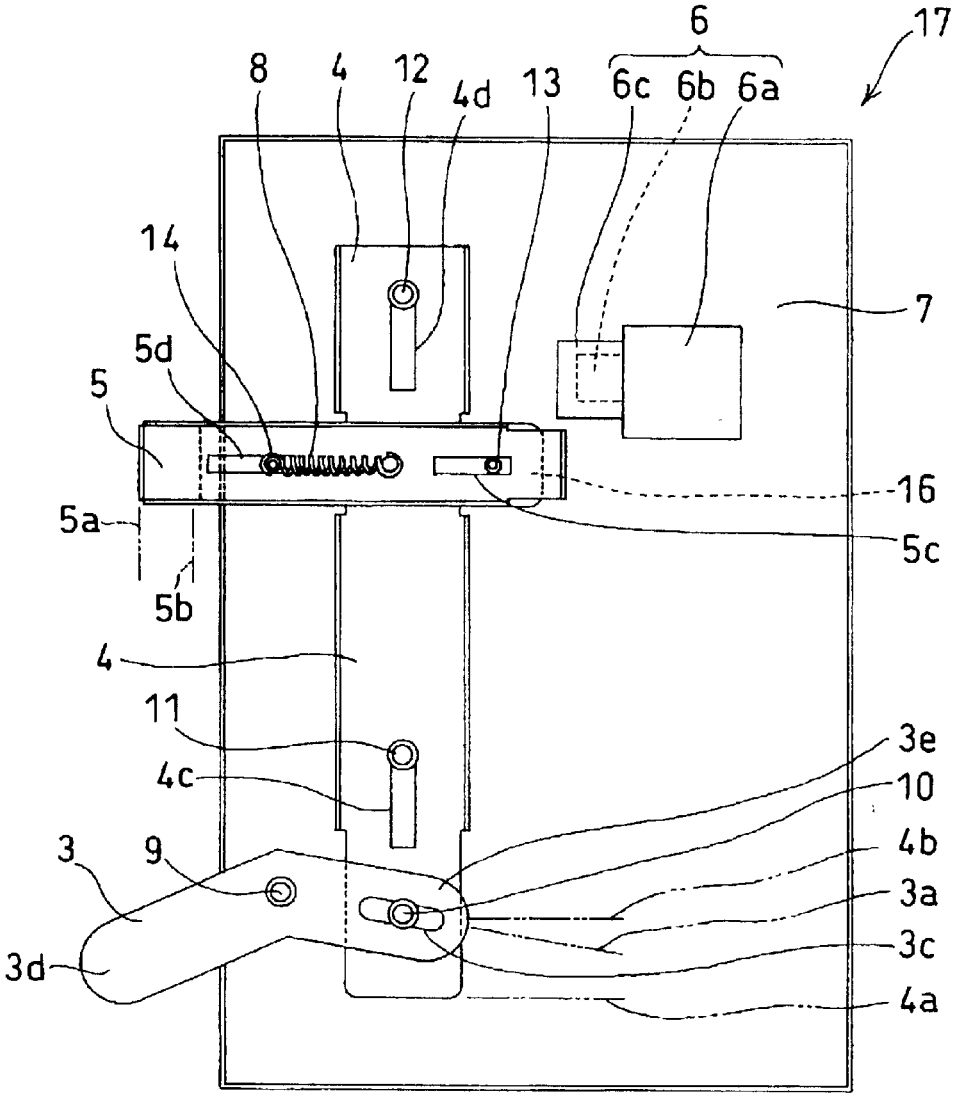
FIG. 1 is a side elevation showing the preferred embodiment of an interlock device according to the present invention illustrating a condition where both of two doors are opened.
Figure 2:
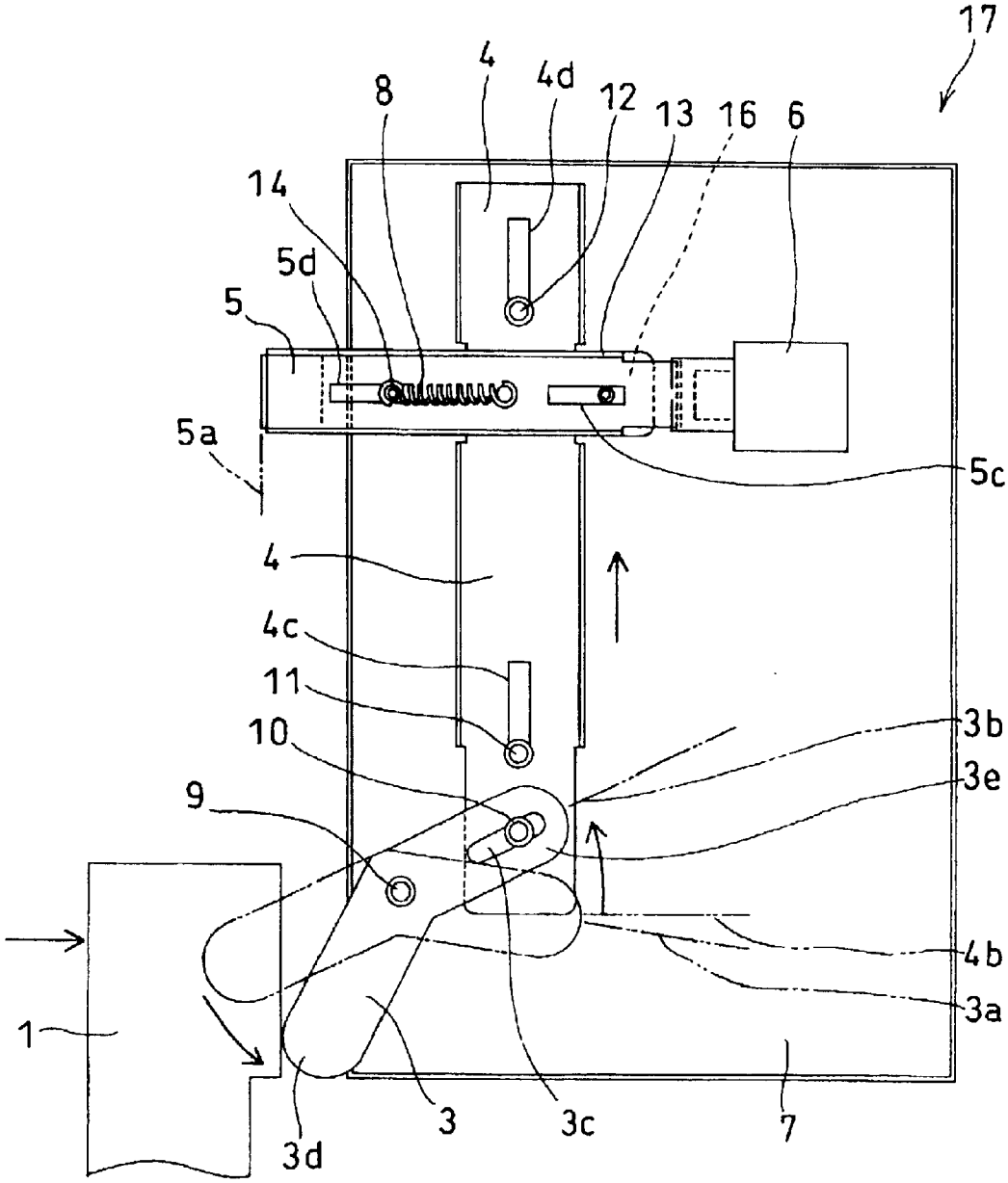
FIG. 2 is a side elevation showing the preferred embodiment of the interlock device according to the present invention illustrating a condition where only one of the two doors is closed.
Figure 3:
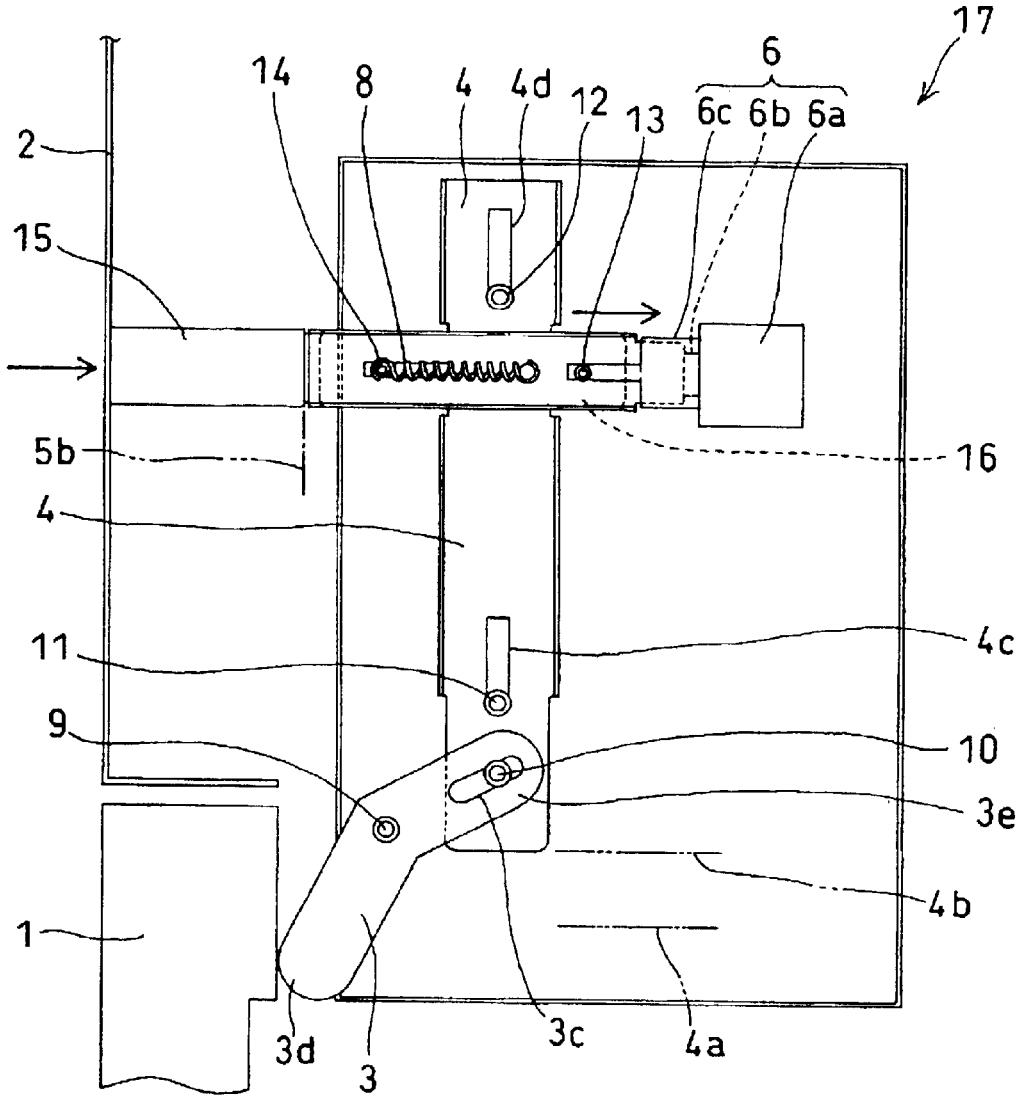
FIG. 3 is a side elevation showing the preferred embodiment of the interlock device according to the present invention illustrating a condition where the other door is also closed from the condition shown in FIG. 2.

FIGS. 1 to 3 are side elevations of the preferred embodiment of an interlock device according to the present invention. In a casing (not shown) for housing an apparatus, such as a control panel or the like (not shown), a quadrangular opening portion (not shown) is provided in the front side for maintenance and inspection of the apparatus. The opening portion is opened and closed by two doors 1 and 2 shown in FIG. 3. FIG. 1 shows a condition where both of two doors 1 and 2 are opened, FIG. 2 shows a condition where only one door 1 is closed and the other door 2 is closed, and FIG. 3 shows a condition where both doors 1 and 2 are closed.

The door 1 is hinged on a horizontal shaft extending along the lower edge of the opening portion of the casing, and the door 2 is hinged on a horizontal shaft extending along the upper edge, namely the edge opposing to the edge on which the door 1 is hinged. The doors 1 and 2 are opened and closed about the horizontal shafts in hinged double door fashion. On the door 2, a projecting portion 15 is locally provided on the inner surface (see FIG. 3). On the other hand, within the casing, in the vicinity of the position where the tip ends of the doors 1 and 2 mate in the opening portion, an interlock device 17 according to the present invention is provided.

As shown in FIG. 1, in the interlock device 17, a quadrangular plate forming a base plate 7 is rigidly secured on the casing and orienting to form a mount for the interlock device. On the lower portion of the base plate 7, a rotary shaft 9 is horizontally secured. On the rotary shaft 9, an intermediate portion of a lever 3 is supported so that the lever 3 may pivot about the rotary shaft. The lever 3 is bent at the intermediate portion to provide different directions to a first end portion 3*d* and a second end portion 3*e* across the pivoted portion, pivoted on the rotary shaft 9. A first end portion of the lever 3 extends at an angle greater than 180° from the second end potion to contact the door 1 when door 1 is pushed to close. On the other hand, the second end portion 3*e*, contains an elliptic slit 3*c* extending in the direction along which the second end portion 3*e* extends.

On the other hand, studs 11 and 12 are mounted on the base plate 7. The stud 11 is located in vertical alignment with the stud 12. On the studs 11 and 12, s link member 4 is mounted. The link member 4 is a vertically extending strip form. In a lower portion and an upper portion of the link member 4, vertically extending rectangular slits 4*c* and 4*d* are provided. The studs 11 and 12 are engaged with respective slits 4*c* and 4*d* so that the link member 4 may move from a position 4*a* to a position 4*b*. Namely, studs 11 and 12 are moved relatively within the slits 4*a* and 4*d*. It should be noted that the position 4*a* is located lower side of the position 4*b*, namely on the side of the door 1. As set forth above, the link member 4 is mounted on the base plate 7 via the studs 11 and 12.

Furthermore, on the lower side of the slit 3*c* in the link plate 4, a stud 10 is mounted. The stud 10 engages with the slit 3*c* of the lever 3 for sliding movement. By this, the link member 4 engages with the lever 3 to cause vertical movement of the link member 4 by the pivoting motion of the lever 3. Normally, the link member 4 is located at the position 4*a* by gravity. At this time, the first end portion 3*d* of the lever projects beyond the base plate 7. The second end portion 3*e* of the lever 3 is located at the position 3*a*. At this condition, when the door 1 (see FIG. 3) is closed, the door 1 pushes the one side portion 3*d* of the lever 3 for pivoting the lever 3 about the rotary shaft 9.

On the other hand, between the slits 4*c* and 4*d* in the link member 4*a* guide plate 16 extending in horizontal direction is mounted. On the guide plate 16, studs 13 and 14 are mounted.

On the other hand, in the interlock device 17, a pushing member 5 is provided. The pushing member 5 has a horizontally extending strip shape. In the pushing member 5, horizontally extending rectangular slits 5*c* and 5*d* are provided. The studs 13 and 14 on the guide plate 16 are engaged with respective slits 5*c* and 5*d* for relative movement with respect to the slits 5*c* and 5*d*. Thus, the pushing member 5 is movable in the longitudinal direction of the guide plate 16, namely movable from a position 5*a* to a position 5*b*. On the other hand, between the guide plate 16 and the pushing member 5, a bias spring 8 is provided for biasing the pushing member 5 toward the position 5*a*. By this, when a load is not applied to the pushing member 5, the pushing member 5 is placed at the left side end in the motion range, namely at the position 5*a*.

Also, the switch 6 is rigidly secured on the base plate 7. The switch 6 is adapted to supply electric power to the apparatus, such as the control panel or the like, when the switch 6 is depressed. The switch 6 is constructed with a main body 6*a*, a pushing portion 6*b* and a cover 6*c* covering the pushing portion 6*b*. The pushing portion 6*b* of the switch 6 is arranged at a position to be depressed by the pushing member 5 when the link member 4 is moved to the upper end of the motion range, namely moved at the position 4*b*, and the pushing member 5 is moved to the right side end in the motion range, namely at the position 5*b*.

Next, a discussion will be provided for operation of the interlock device 17. As shown in FIG. 1, when both of the doors 1 and 2 are opened, the link member 4 is located at the lowermost position of its motion range, namely the position 4*a* by weight of the link member 4, the guide plate 16 and the pushing member 5. At this time, the first end portion 3*d* of the lever 3 projects beyond the base plate 7 into the opening and the second end portion 3*e* of the lever 3 is located at the position 3*a*. On the other hand, the pushing member 5 is biased by a resilient force of the spring 8 to the position 5*a*. At the position 5*a*, even when the door 2 is closed, the pushing member 5 cannot push the pushing portion 6*b* of the switch 6.

Next, as shown in FIG. 2, by closing the door 1, the tip end of the one side portion 3*d* of the lever 3 is pushed by the door 1. Then, the lever 3 is pivoted in counterclockwise direction in the drawing to move the tip end portion of the other side portion 3*e* from the position 3*a* to the position 3*b*. Associating with pivotal movement of the lever 3, the stud 10 of the link member 4 is slid within the slit 3*c* of the lever 3 to push the link member 4 upward. By this, the link member 4 is moved from the position 4*a* to the position 4*b*. At this time, the studs 11 and 12 are relatively slid within the slits 4*a* and 4*b* to serve as guide for the link member 4. By placing the link member 4 at the position 4*b*, the guide plate 16 and the pushing member 5 are also moved. As a result, the height of the pushing member 5 becomes equal to the height of the switch 6.

Next, as shown in FIG. 3, by further closing the door 2, the projecting portion 15 of the door 2 is pushed by the pushing member 5. By this, the pushing member 5 is moved from the position 5*a* to the position 5*b* against the resilient force of the spring 8. At this time, the studs 13 and 14 are relatively slid within respective slits 5*c* and 5*d* to serve as guide for movement of the pushing member 5. By movement of the pushing member 5 to the position 5*b*, the pushing member 5 pushes the pushing portion 6*b* of the switch 6 to turn ON the switch. Thus, power is supplied to the apparatus.

As set forth above, in the shown embodiment of the interlock device, the construction is such that the pushing portion 6*b* of the switch 6 cannot be depressed unless the door 1 is closed first and then the door 2 is closed. Namely, only when both of the doors 1 and 2 are closed, is the power supplied to the apparatus. When at least one of the doors 1 and 2 is open, the power is not supplied to the apparatus. Even when both doors are closed, the switch 6 cannot be pushed, unless the door 1 is closed first and then the door 2 is closed. Namely, the power is not supplied to the apparatus unless the doors 1 and 2 are closed in predetermined sequence. As set forth above, the shown embodiment of the interlock device certainly prevents turning ON of power when at least one of the two doors is opened. As a result, a misstep of turning ON the power supply for the apparatus in the condition where at least one door is opened, or a misstep of opening of at least one door during operation of the apparatus, can be certainly prevented. Also, in the shown embodiment of the interlock device, such a function can be realized by one switch.

On the other hand, since the edges of the lever 3 on the side intersect at the angle greater than 180° to be pushed by the door 1, the lever 3 is pushed by the door 1 when the door 1 is closed. By rotation of the lever 3, motion of the door 1 can be converted into vertical linear motion of the link member 4, effectively.

It should be noted that, in the shown embodiment, the position 4*a* is arranged at the lower portion than the position 4*b*. Therefore, when the door 1 is opened, the link member 4, the guide plate 16 and the pushing member 5 are stacked to place the link member 4 at the position 4*a*. By this, it becomes unnecessary to locate the position 4*a* at lower position than the position 4*a* to increase freedom in arranging the interlock device 17.

As set forth above, with the present invention, it becomes possible to obtain the interlock device provided in the casing having two doors and housing the apparatus, in which the power is supplied to the apparatus only when both of two doors are closed. By this, turning ON the power supply for the apparatus in the condition where the door is opened or opening of the door during operation of the apparatus can be prevented. Thus, security in maintenance and inspection of the apparatus, in replacement of parts and in operation can be improved.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An interlock device for a casing which includes an opening and first and second doors in a hinged double door construction, comprising:

a lever, pivotably supported at an intermediate portion, that pivots a first end portion of said lever downward, as said first end portion is contacted by a first door of said hinged double doors, when said first door closes a portion of said opening;

a link member with a stud, said stud moving said link member upward from a first position to a second position, in response to an upward motion of a second end portion of said lever, when said first door is closed;

a pushing member mounted on a guide plate of said link member, said pushing member being pushed inward by a projecting portion of a second door of said hinged double doors to a third position, when said link member is located at said second position and said projecting portion contacts said pushing member, as said second door closes a remaining portion of said opening; and a switch that turns ON a power supply, when said pushing member contacts said switch in said third position.

2. An interlock device as set forth in claim 1, which further comprises a second resilient member connected between said casing and said link member, which constantly biases said link member toward said first position.

3. An interlock device as set forth in claim 1, wherein said pushing member is mounted transversely on said link member, such that a first direction of said being pushed inward intersects with a second direction of said link member moving upward.

4. An interlock device as set forth in claim 1, wherein said pushing member is resiliently disposed at a fourth position, when said second door is not closed, and a first resilient member that is connected to said guide plate and said pushing member to resiliently bias said pushing member toward said fourth position.

5. An interlock device as set forth in claim 1, wherein said first door and said second door pivot about corresponding horizontal shafts, an opening, which is closed by said first door and said second door, is disposed at a front side of said casing, said lever is pivotable about a horizontal shaft, and said link member is constantly biased toward said first position by gravity.

6. An interlock device as set forth in claim 1, wherein said first end portion and said second end portion form an angle greater than 180°.

7. An interlock device for a casing with a first door and a second door in hinged double door construction, comprising:

a lever, pivotably supported at an intermediate portion and being pivoted in a first direction as a first end portion of said lever is pivoted by said first door when said first door is closed;

a link member responsive to pivot motion of said lever and moved by a second end of said lever from a first position, opposite said first door, to a second position, opposite said second door;

a pushing member mounted on said link member and responsive to closure of said second door, when said link member is located at said second position, said pushing member being pushed to a third position, when said second door is closed; and a switch responsive to said pushing member, when located at said third position, said pushing member pushing said switch ON, wherein said pushing member is mounted on said link member in such a manner that a first direction of movement of said pushing member, as pushed, intersects with a second direction of movement for said link member.

8. An interlock device for a casing with a first door and a second door in hinged double door construction, comprising:

a lever, pivotably supported at an intermediate portion and being pivoted in a first direction as a first end portion of said lever is pivoted by said first door when said first door is closed;

a link member responsive to pivot motion of said lever and moved by a second end of said lever from a first position, opposite said first door, to a second position, opposite said second door;

a pushing member mounted on said link member and responsive to closure of said second door, when said link member is located at said second position, said pushing member being pushed to a third position, when said second door is closed; and a switch responsive to said pushing member, when located at said third position, said pushing member pushing said switch ON, wherein when said pushing member is located at a fourth position, a first resilient member biases said pushing member toward said fourth position and is connected between said link member and said pushing member, said pushing member being pushed at said fourth position, when said second door is closed.

9. An interlock device for a casing with a first door and a second door in hinged double door construction, comprising:

a lever, pivotably supported at an intermediate portion and being pivoted in a first direction as a first end portion of said lever is pivoted by said first door when said first door is closed;

a link member responsive to pivot motion of said lever and moved by a second end of said lever from a first position, opposite said first door, to a second position, opposite said second door;

a pushing member mounted on said link member and responsive to closure of said second door, when said link member is located at said second position, said pushing member being pushed to a third position, when said second door is closed; and a switch responsive to said pushing member, when located at said third position, said pushing member pushing said switch ON, wherein said first door and said second door pivot about horizontal shafts, an opening, which is closed by said first door and said second door, is disposed at a front side of said casing, said lever is pivotable about a horizontal shaft, said first position is disposed lower than said second position, and said link member is constantly biased toward said first position by gravity.

10. An interlock device for a casing with a first door and a second door in hinged double door construction, comprising:

a lever, pivotably supported at an intermediate portion and being pivoted in a first direction as a first end portion of said lever is pivoted by said first door when said first door is closed;

a link member responsive to pivot motion of said lever and moved by a second end of said lever from a first position, opposite said first door, to a second position, opposite said second door;

a pushing member mounted on said link member and responsive to closure of said second door, when said link member is located at said second position, said pushing member being pushed to a third position, when said second door is closed; and a switch responsive to said pushing member, when located at said third position, said pushing member pushing said switch ON, wherein said lever is bent at said intermediate portion, said first end portion and said second end portion extending in different directions at an angle greater than 180°.

11. An interlock device for a switch housed within a casing, which includes a first door and a second door that close an opening, comprising:

a lever pivotably connected to said casing, a first end of said lever pivoting downward, when pushed by said first door to close a portion of said opening;

a link member that slides upward, when a stud attached to said link member is moved upward by a second end of said lever, as said first end pivots downward;

a pushing member, connected to said link member, that inwardly pushes said switch, when said link member has slid upward and a portion of said second door pushes on said pushing member, as said second door closes a remaining portion of said opening.

12. An interlock device according to claim 11, wherein said lever pivots about a rotary shaft attached to an inner surface of said casing.

13. An interlock device according to claim 11, wherein said first end and said second end of said lever form an angle greater than 180°.

14. An interlock device according to claim 11, wherein a longitudinal axis of said link member is oriented vertically.

15. An interlock device according to claim 11, wherein said link member includes a slit and said link member slides upward on a stud, which protrudes through said slit and is attached to said casing.

16. An interlock device according to claim 11, wherein said pushing member is slidably disposed on a guide plate, which is transversely attached to said link member.

17. An interlock device according to claim 11, wherein said pushing member is outwardly biased by a bias spring connected between said pushing member and said guide plate.

18. A method of interlocking a switch disposed withing a casing including a first door and a second door that close an opening, comprising:

closing a portion of said opening with a first door, so that, a pivoting lever contacted by said first door upon closing said portion causes a link member to slide upward;

closing a remaining portion of said opening by a second door, so that a pushing member transversely connected to said link member is pushed inward by a portion of said second door and said pushing member pushes upon said switch.

* * * * *